US006026886A

United States Patent [19]

Diamond-Martinez

[11] Patent Number: 6,026,886

[45] Date of Patent: Feb. 22, 2000

[54] WINDOW COVERING

[76] Inventor: Deirdre A. Diamond-Martinez, 5240 Golf Valley Way, Stone Mountain, Ga. 30088

[21] Appl. No.: 09/286,962

[22] Filed: Apr. 6, 1999

[51] Int. Cl.[7] ..... E06B 3/48

[52] U.S. Cl. ..... 160/113; 160/201; 160/369

[58] Field of Search ..... 160/113, 116, 160/201, 327, 354, 368.1, 369

[56] References Cited

U.S. PATENT DOCUMENTS

| | | | |
|---|---|---|---|
| 52,577 | 2/1866 | Landis . | |
| 543,763 | 7/1895 | Balsley . | |
| 1,613,270 | 1/1927 | Glover . | |
| 1,744,177 | 1/1930 | Schuler . | |
| 2,314,026 | 3/1943 | Willett . | |
| 2,606,608 | 8/1952 | Stewart . | |
| 3,276,512 | 10/1966 | Gallagher . | |
| 3,763,917 | 10/1973 | Antinone . | |
| 3,927,790 | 12/1975 | Anderson et al. | 160/116 X |
| 4,044,813 | 8/1977 | Emmons . | |
| 5,385,194 | 1/1995 | Brown . | |
| 5,649,390 | 7/1997 | Davidson | 160/201 X |
| 5,839,237 | 11/1998 | Davidson | 160/201 X |
| 5,943,803 | 8/1999 | Zinbarg | 160/201 X |

OTHER PUBLICATIONS

Catalog comprising 9 pages; *Stylecraft Design Trim*; National Door Industries, Inc., Dec. 1998.

*Primary Examiner*—David M. Purol
*Attorney, Agent, or Firm*—Hinkle & Associates, P.C.

[57] ABSTRACT

A window covering for mounting to the interior of a garage door window which will give the effect of a stylized window. The window covering comprises a central panel of desired material with a border of contrasting material attached thereto, wherein the border replicates a predetermined geometrical shape to give the effect of a stylized window and the border has attached thereto attachment tabs for attaching the window covering to the garage door. The attachment tabs are comprised of a front portion and a rear portion to define a loop therebetween so that the tab may be affixed to the garage door by fasteners placed through the tabs or by a rigid frame member placed through the loop and then the rigid frame member is attached to the door.

18 Claims, 3 Drawing Sheets

WINDOW COVERING

BACKGROUND OF THE INVENTION

I. Field of the Invention

The present invention relates generally to the field of window coverings. More particularly, the present invention relates to a specialized window cover especially useful for automobile garage doors which typically have a row of windows across an upper portion of the garage door. This particular invention provides a window covering for such garage door windows which will give a visual effect to the outside of a window which has a specialized visual impact to a person observing the window.

II. Description of the Related Art

As is well known, there are many styles of window coverings known in the prior art. For instance, there are innumerable window shades which are used to cover window panes and to block out light, and to give an impression of a particular design when looking at the window shade from the exterior of a building. Further, there are many types of fabric window coverings which are normally viewed from the interior of a building. In addition, the prior art discloses a great many types of hardware for hanging both blinds and window shades.

Further, windows come in a great number of styles and configurations so that the visual impact to the exterior of a building can be quite varied depending upon the style of window utilized. For instance, windows are known to come in many shapes such as rectangular shapes, square shapes, arches, Palladian windows and other styles. In addition, it is quite well known to take a rectangular or square type window and add a design treatment thereto to give the look and feel of a more stylistic window. For instance, there are trims currently on the market manufactured by National Door Industries, Inc., under the trade name of STYLE CRAFT DESIGN TRIM. These types of products will give a rather plain looking window the design treatment of a rather stylistic window.

However, it is not known in the prior art to have a treatment system designed for the homeowner to utilize with automobile garage type doors which, when mounted to the interior of the door, will give the effect to the exterior of a very stylistic type design.

SUMMARY OF THE INVENTION

In accordance with the present invention and the contemplated problems which have and continue to exist in this field, the objectives of this invention are to provide a window covering treatment system which is easily fabricated by the homeowner and mounted to the inside of a automobile garage door system for covering the typical window panes mounted in the garage doors. The system of the present invention utilizes fabric of a quality and design selected by the homeowner and fabricated in various ways to present a stylistic design to the exterior of the building to replicate a variety of identifiable styled windows. When fabricating the covering of the present invention, there is a border of contrasting material to the main covering panel wherein the border material is affixed, preferably by sewing, to the main covering panel and will have a configuration to replicate the well known window style so that when it is mounted to the interior of the window portion of the garage door the border material of the window covering panel will show through the door window giving the impression of a stylized window. The window covering of the present invention may be mounted in any of several ways, but principally by a system fixing the covering to the door by staples, nails or the like, or by a hook and loop fastening system. In addition, the covering may be mounted by a rigid frame to which is attached the window covering, and then the frame is mounted to the door.

Other objects, advantages and capabilities of the invention will become apparent from the following description taken in conjunction with the accompanying drawings showing preferred embodiments of the invention.

DESCRIPTION OF THE PREFERRED EMBODIMENT

Figure 1:
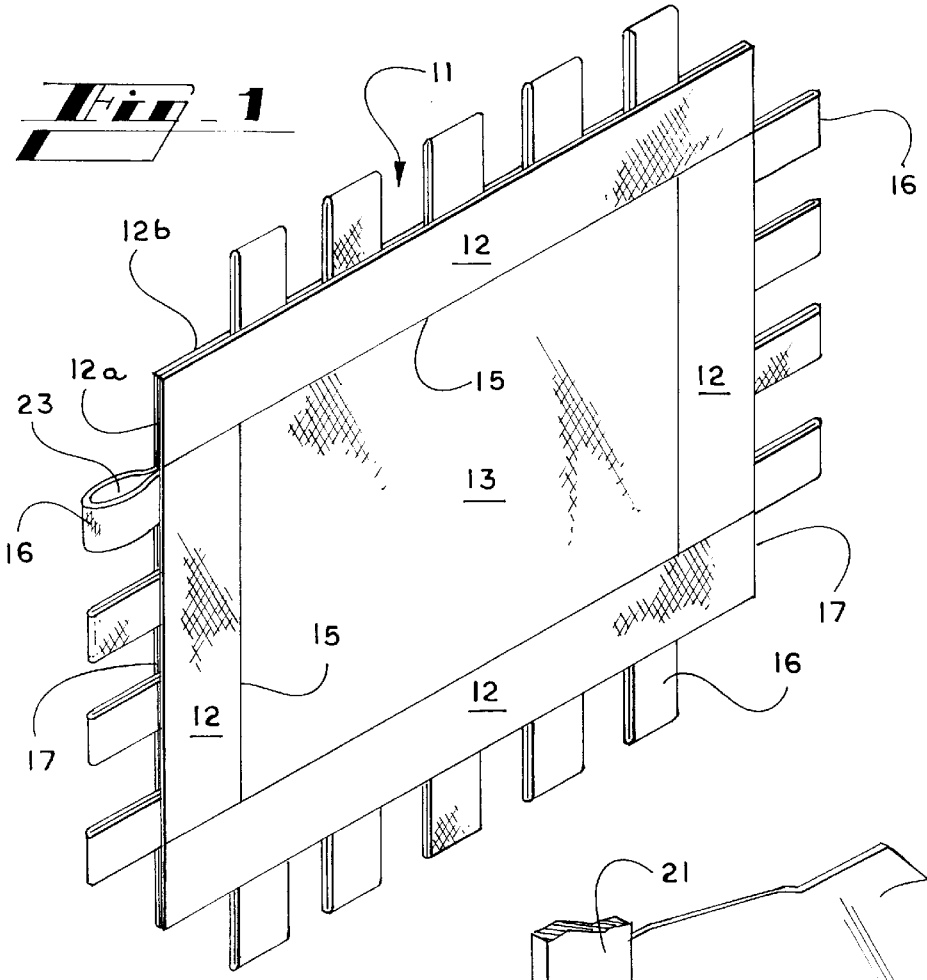
FIG. 1 is a perspective view of a window covering of the present invention in a rectangular form.

For a fuller understanding of the nature and desired objects of this invention, reference should be made to the following detailed description taken in connection with the accompanying drawings. Referring to the drawings wherein like reference numerals designate corresponding parts throughout the several figures, reference is made first to FIG. 1 wherein the window covering of the present invention is generally indicated by the numeral 11. The window covering 11 generally comprises a flat panel of flexible material such as fabric and is constructed to have a stylized border 12 and a main covering panel 13. The border 12 will typically take the configuration of the stylized window which the homeowner desires to present to the public on the exterior of the garage door 14 (see FIG. 5). To give the desired visual impact, it is anticipated that the border will have a contrasting color to the main covering panel. In the case shown in FIG. 1, the border 12 is replicating a horizontally disposed, rectangular type of window which is typical of many garage doors. The fabric of border 12 will typically be doubled into a front border section 12*a* and a rear border section 12*b*. Affixed between the front section 12*a* and the rear section 12*b* is the main covering panel 13, which will normally be affixed by stitching of panel 13 to the inner edges 15 of sections 12*a* and 12*b*. Once the border material 12 has been affixed to the main covering panel 13 and prior to affixing the front and rear sections 12*a* and 12*b* together, it will be necessary to insert a plurality of attachment tabs 16 between the front and rear sections 12*a* and 12*b* respectively. Attachment tabs 16 are the means by which the window covering 11 may be attached to the garage door.

Once the attachment tabs 16 are placed between front section 12*a* and rear section 12*b*, the fabricator may then affix, preferably by stitching, the outer edges 17 of the border material all the way around the periphery of the border 12 thereby affixing the front section 12*a* to rear section 12*b*, and affixing the attachment tabs 16 therebetween. Once this process is completed, the window covering is then prepared for mounting to the door 14.

Figure 5:
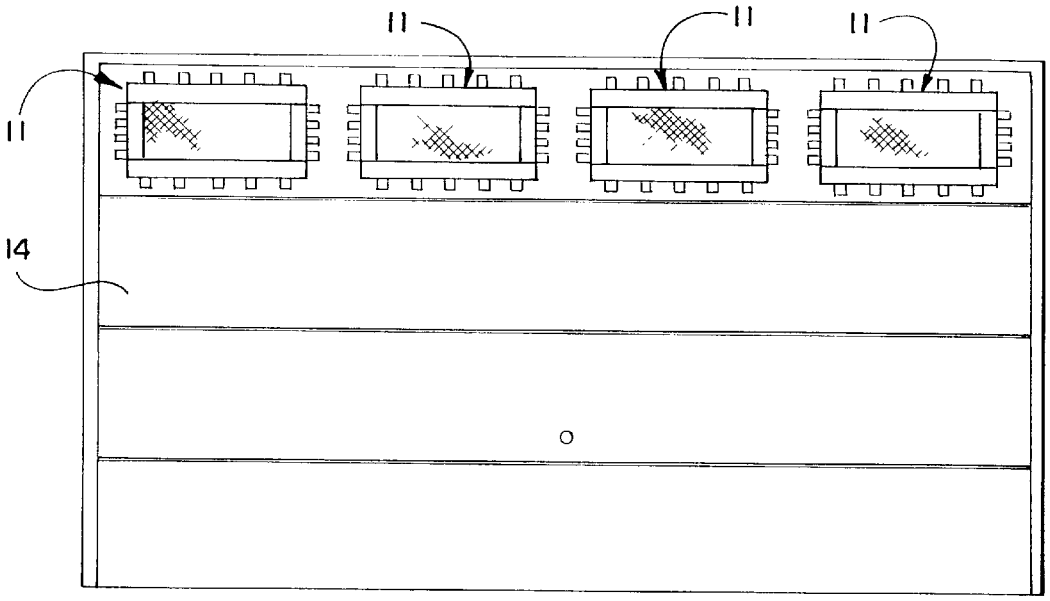
FIG. 5 is an elevation view of a typical automobile garage door opening showing the interior thereof with the window covering units of the present invention mounted to the window frame areas of the door.

Referring to FIG. 5, door 14 is shown with an elongated, rectangular window covering 11 mounted thereto, wherein the covering is similar to that shown in FIG. 1. Once the window covering units 11 are affixed to the door from the inside thereof, a person viewing the door from the outside will view the border 12 is appearing as a frame around a contrasting main covering panel 13 and will recognize a pleasing visual effect.

Figure 2:
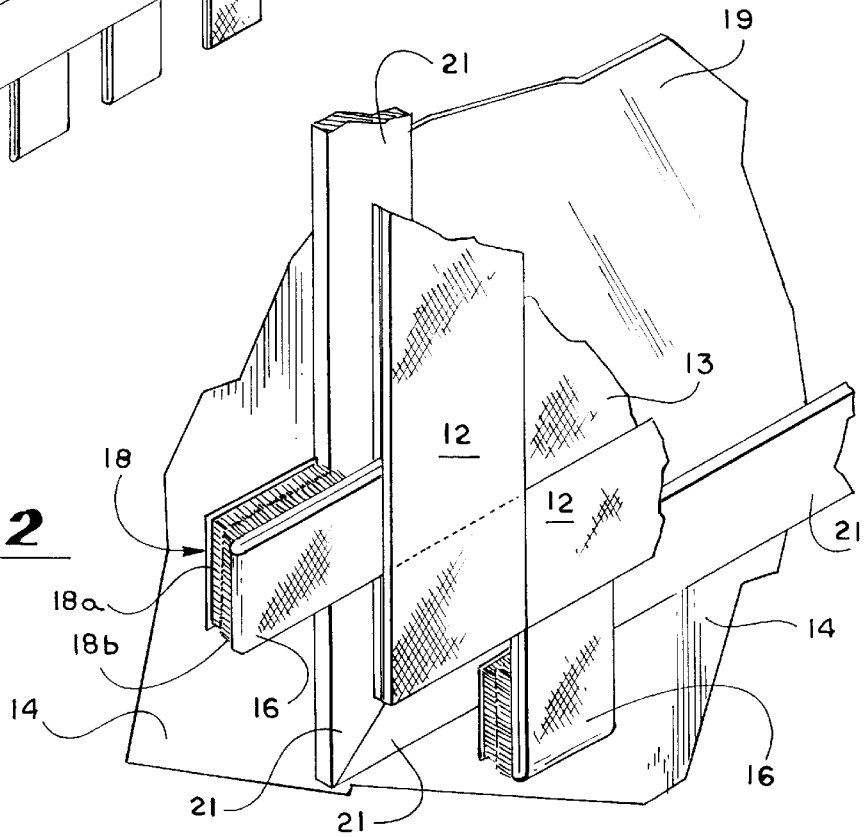
FIG. 2 is a perspective cutaway view showing the window covering being mounted to a garage door window unit by hook and loop fastening means.

To more fully understand the mounting system of the present invention, reference is next made to FIG. 2 which shows the window covering 11 being mounted to the garage door 14 by means of a hook and loop fastening system 18 which will typically comprise a hook panel 18*a* and a loop panel 18*b*, which latter loop panel is affixed to each attachment tab 16, while the hook panel 18*a* is affixed to the door 14. Since each attachment tab will have a loop panel 18*b* attached thereto, or in the alternative would have hook panel 18*a* attached with the loop panel 18*b* being attached to the door, it is merely a simple matter to affix the window covering 11 over the window pane area 19 of door 14. As is evident in FIG. 2, the window pane 19 is mounted to the door 14 by means of window pane molding 21 in the normal manner.

Figure 3:
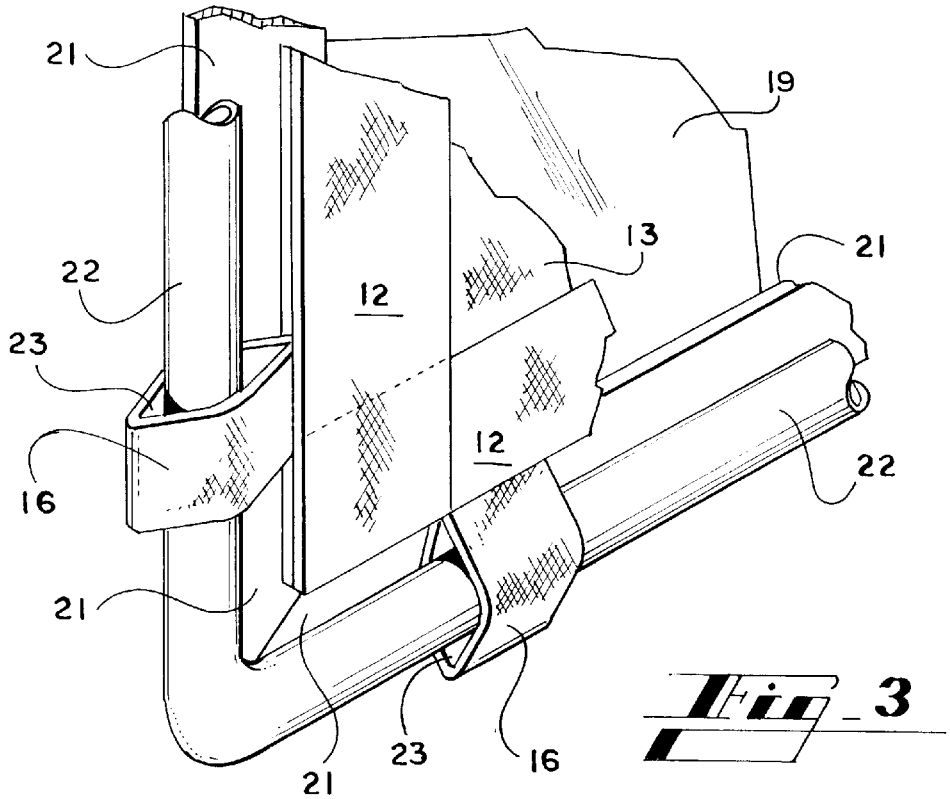
FIG. 3 is a perspective cutaway view showing the window covering being mounted to a garage door window unit by a rigid mounting system.

Referring to FIG. 3, an alternative type of mounting system is shown wherein the window covering 11 is mounted to the door by means of a fixed hanging rod 22. Typically, this type of rod may be a round type rod as shown in FIG. 2, or may be flat or any other configuration which will accomplish the intended purpose. In any event, the hanging rod 22 is placed within the loop opening 23 in each attachment tab. Once the window covering 11 has been threaded onto the hanging rod, the rod would then be attached to the door by means of brackets or any other suitable mounting mechanism.

Figure 4:
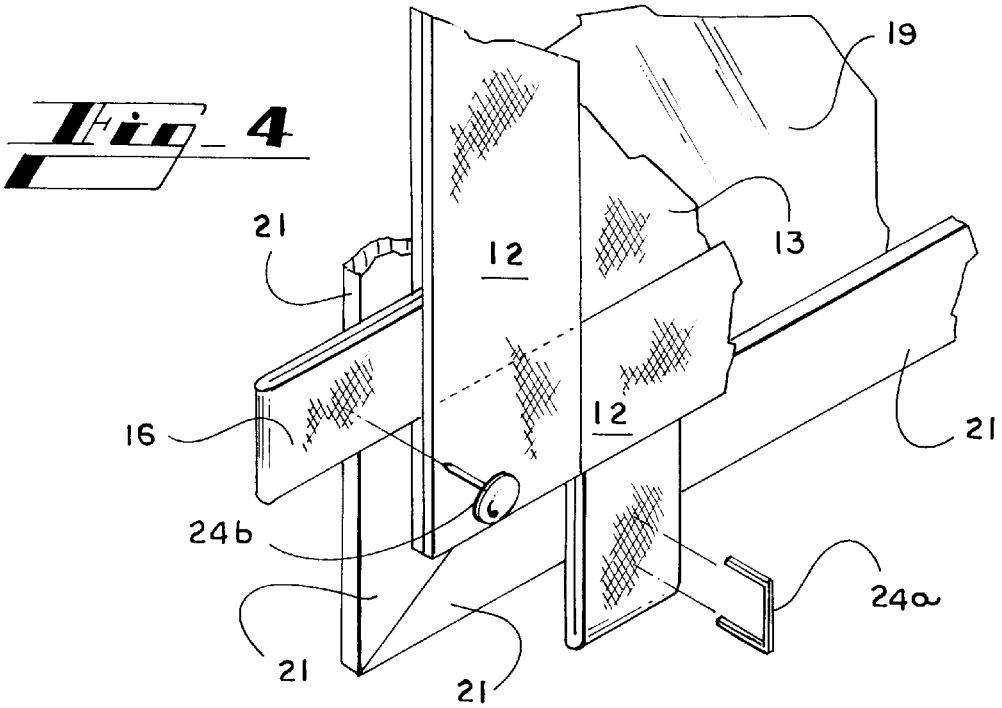
FIG. 4 is a perspective cutaway view showing the window covering being mounted to a garage door window unit by a staple and tack fastening system.

In FIG. 4 an alternative mounting system is shown wherein the user might well affix the window covering over the window pane area of the door by means of a staple fastener 24*a*, which would be placed in each attachment tab and stapled into the door member. Alternatively, a tack 24*b* may be used to secure tabs 16 to the door member. This type of fastening system would be easy to accomplish and would allow the user access thereto for easy removal.

Figure 6:
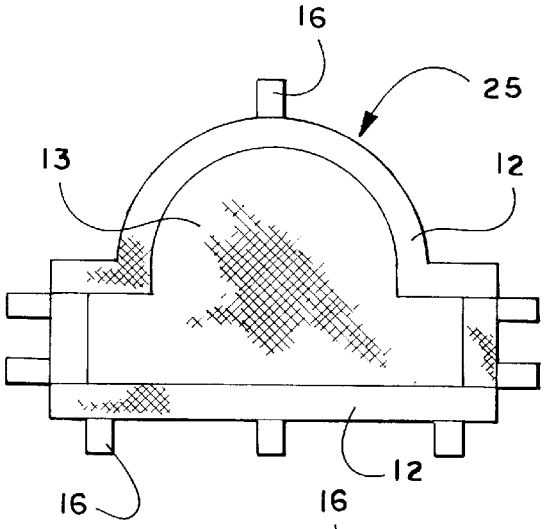
FIG. 6 is a window covering of the present invention replicating a Palladian window.
Figure 7:
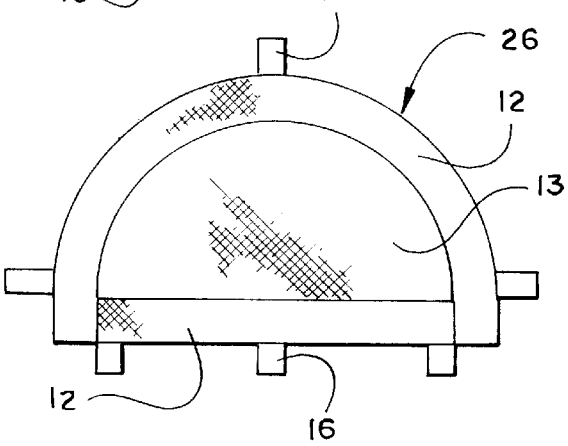
FIG. 7 is a window covering panel of the present invention replicating a round-headed archway window.
Figure 8:
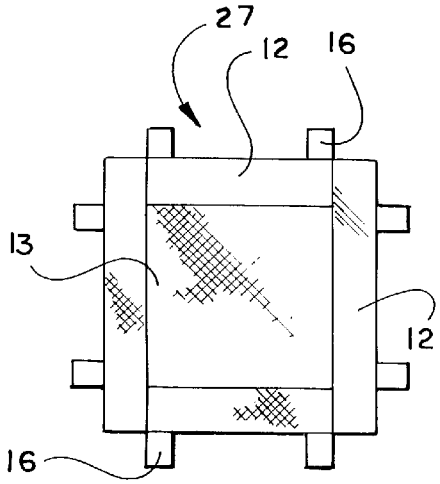
FIG. 8 is a window covering panel of the present invention replicating a square window.

Other designs of the window covering might very well be manufactured, and these designs might be quite extensive in scope. Several possible designs are shown in FIGS. 6, 7 and 8. The design of the window covering in FIG. 6 shows a Palladian window shape 25 which, when placed over the window of the door 14, will give a visual appearance of a Palladian type window from the outside. It is anticipated that the entire round-headed, top portion of the Palladian window would be visible from the exterior, although this would leave a certain amount of window pane being open to view from the outside to the inside. However, the effect would still be of a Palladian type window.

In FIG. 7, a round-headed archway configuration 26 is shown which would be mounted to the door 14 in a manner similar to that of the Palladian window 25 and, again, the window pane would allow some viewing from exterior to interior because of the incomplete covering of the window pane.

The alternative window covering of FIG. 8 shows a square configuration which would be designed to fit square windows in door 14, and it would be mounted in the manner as shown in FIG. 1 utilizing the mounting attachment tab 16 with any of the various mounting mechanisms previously described.

While it has been described that the window covering 11 may have stylized shapes such as in FIGS. 5, 6 and 7, obviously these covering shapes will not fully cover all of the exposed window pane 19. Therefore, the user may want to put a background material behind the covering 11 to block out the line of sight. However, there are many garage doors which are manufactured with a glass pane of the shape of FIGS. 5, 6 and 7, along with a great many other shapes. In such instances, the described covering will fit the window correctly.

Therefore, the foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. In combination with a garage door having at least one window mounted in surrounding door mounted molding, a window covering comprising:

the window covering having a peripheral border of defined geometrical shape, the border having an inner edge therearound and an outer edge therearound, a central covering panel having peripheral edges, the central covering panel peripheral edges being attached to the inner edge of the peripheral border, mounting means to mount the window covering to the garage door comprising attachment tabs mounted in juxtaposition with the outer edge of the border and spaced at predetermined locations along the outer edge, and means for attaching the attachment tabs to the garage door around the window.

2. A window covering as claimed in claim 1, wherein the peripheral border comprises a front section and a rear section, the front and rear sections being affixed to one another in overlying registered relationship.

3. A window covering as claimed in claim 2, wherein the central covering panel peripheral edges are attached to the border between the front and rear sections of the border.

4. A window covering as claimed in claim 1, wherein the attachment tabs comprise an elongated strip of material folded over to form a front strip and a rear strip, which strips are aligned in registry overlying one another and defining a loop area therebetween.

5. A window covering as claimed in claim 4, wherein the attachment tabs are affixed to the garage door to place the window covering overlying the window such that a first portion of the border and all of the central covering panel overlies the window, and a second portion of the border overlies the door.

6. A window covering as claimed in claim 5, wherein the attachment tabs are affixed to the garage door by staples.

7. A window covering as claimed in claim 5, wherein the attachment tabs are affixed to the garage door by tacks.

8. A window covering as claimed in claim 5, wherein the attachment tabs are affixed to the garage door by a hook and loop fastener.

9. A window covering as claimed in claim 5, wherein the attachment tabs are affixed to a rigid frame threaded through the loop of the attachment tabs and thence the rigid frame is affixed to the garage door.

10. A window covering as claimed in claim 1, wherein the peripheral border has the shape of a rectangle.

11. A window covering as claimed in claim 1, wherein the peripheral border has the shape of a square.

12. A window covering as claimed in claim 1, wherein the peripheral border has the shape of a round-headed archway.

13. A window covering as claimed in claim 1, wherein the peripheral border has the shape of a Palladian archway window.

14. In combination with a garage door having a least one window mounted in a surrounding window door mounted molding, a window covering comprising:

the window covering having a peripheral border of defined geometrical shape, the border having an inner edge therearound and an outer edge therearound, a central covering panel having peripheral edges, the central covering panel peripheral edges being attached to the inner edge of the peripheral border, mounting means to mount the window covering to the garage door comprising attachment tabs mounted in juxtaposition with the outer edge of the border and spaced at predetermined locations along the outer edge, means for attaching the attachment tabs to the garage door around the window, the peripheral border comprises a front section and a rear section, the front and rear sections being affixed to one another in overlying registered relationship, the central covering panel peripheral edges are attached to the border between the front and rear sections of the border, the attachment tabs comprise an elongated strip of material folded over to form a front strip and a rear strip, which strips are aligned in registry overlying one another and defining a loop area therebetween, and the attachment tabs are affixed to the garage door to place the window covering overlying the window such that a first portion of the border and all of the central covering panel overlies the window, and a second portion of the border overlies the door.

15. A window covering as claimed in claim 14, wherein the peripheral border has the shape of a rectangle.

16. A window covering as claimed in claim 14, wherein the peripheral border has the shape of a square.

17. A window covering as claimed in claim 14, wherein the peripheral border has the shape of a round-headed archway.

18. A window covering as claimed in claim 14, wherein the peripheral border has the shape of a Palladian archway.

* * * * *